United States Patent [19]

Zuurdeeg

[11] 4,222,828

[45] Sep. 16, 1980

[54] PROCESS FOR ELECTRO-CODEPOSITING INORGANIC PARTICLES AND A METAL ON A SURFACE

[75] Inventor: Eduard Zuurdeeg, Ede, Netherlands

[73] Assignee: Akzo N.V., Arnhem, Netherlands

[21] Appl. No.: 45,424

[22] Filed: Jun. 4, 1979

[30] Foreign Application Priority Data

Jun. 6, 1978 [NL] Netherlands ..... 7806188

[51] Int. Cl.[2] ..... C25D 15/00; C25D 15/02

[52] U.S. Cl. ..... 204/16; 204/181 C; 204/DIG. 2

[58] Field of Search ..... 204/16, 181 C, 181 N, 204/DIG. 2

[56] References Cited

U.S. PATENT DOCUMENTS

| | | | |
|---|---|---|---|
| 3,454,487 | 7/1969 | Riddick | 204/180 R |
| 3,677,907 | 7/1972 | Brown | 204/16 |
| 3,764,512 | 10/1973 | Greenwood | 204/180 R |
| 3,787,294 | 1/1974 | Kurosaki | 204/16 |
| 3,844,910 | 10/1974 | Lipp | 204/16 |
| 3,891,542 | 6/1975 | Cordone | 204/16 |
| 4,098,654 | 7/1978 | Helle | 204/16 |

*Primary Examiner*—T. M. Tufariello

*Attorney, Agent, or Firm*—Stevens, Davis, Miller & Mosher

[57] ABSTRACT

A process is provided for the electrolytic codeposition of a metal and solid inorganic particles on an article acting as a cathode. The particles have an average size of less than 300μm and are used in a concentration of 10 to 150 grams per liter of plating bath liquid. The inorganic particles are kept suspended in the bath liquid with a cationic fluorocarbon surfactant present in an amount which is at least the same weight ratio to the particles in the bath liquid as the ratio of surfactant to particles required in an 0.005 N $KNO_3$- solution for the particles to assume a zeta-potential of at least +40 mV. Preferably the surfactant consists of a cationic fluorocarbon compound having the structural formulae:

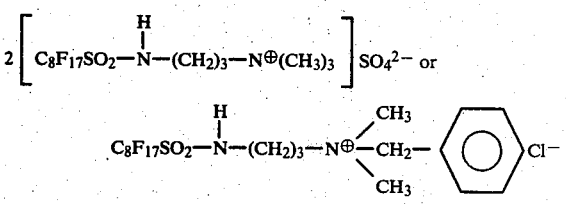

9 Claims, No Drawings

PROCESS FOR ELECTRO-CODEPOSITING INORGANIC PARTICLES AND A METAL ON A SURFACE

This invention relates to a process for depositing composite coatings containing a metal and inorganic particles from an electroplating bath. More specifically, the invention relates to a process for the codeposition from an electroplating bath of a metal and solid inorganic particles on an article acting as a cathode and to the resulting coated article.

One process of the general type indicated above is described in U.S. Pat. No. 3,891,542. In accordance with the disclosed process, nickel and silicon carbide particles are codeposited electrolytically from an aqueous bath on an article which serves as the cathode. The silicon carbide particles are kept suspended in the bath with the aid of a surfactant such as sodium lauryl sulphate. One disadvantage of the disclosed process is that only a low percentage of particles can be incorporated into the composite layers. A weight percentage of silicon carbide particles of 3 to 5% is disclosed. However, this percentage can only be obtained at a relatively high concentration (90 to 150 grams per liter) of silicon carbide particles in the bath liquid. Other required undesirable conditions are an exceptionally high electrolyte concentration and very vigorous agitation of the bath liquid to retard sedimentation of the suspension and to obtain a sufficiently homogeneous distribution of the particles in the coating.

It is an object of this invention to provide an improved process for the simultaneous electrolytic deposition of a metal and solid inorganic particles such as silicon carbide on a surface of an article acting as a cathode. Another object of the invention is to provide such an electrolytic deposition process which makes it possible to incorporate a larger percentage of the inorganic particles in the resulting coating. Still another object of the invention is to provide improved dispersion of the inorganic particles in the electroplating bath without requiring vigorous agitation.

The present invention provides a process which makes it possible to incorporate substantially higher percentages of solid particles in metal coatings with the use of an electroplating bath having a substantially lower concentration of solid particles and electrolyte without vigorous agitation of the bath.

In accordance with the invention, an electroplating bath is provided which contains a surfactant in the form of a cationic fluorocarbon compound in at least the same weight ratio of surfactant to particles in the bath liquid required in an 0.005 N $KNO_3$-solution for the particles to assume a zeta-potential of at least +40 mV with the exclusive use of said cationic fluorocarbon compound as the surfactant.

It should be added that the use of a cationic compound for the codeposition from an electroplating bath of a metal and solid inorganic particles on an object which acts as a cathode has been proposed before in the U.S. Pat. No. 3,844,910. An amino-organosilicon compound, for instance gamma-propyltriethoxysilane, is employed in the disclosed bath to promote the incorporation of non-metallic particles such as silicon carbide in a matrix of metal. Although the results obtained with the process are better than those of the previous processes, the percentage of particles incorporated is still insufficient for many purposes.

Moreover, in the case of a particle size of over 10 microns, the amount of nonmetallic particles that can be incorporated by the disclosed process has been found to decrease with increasing average particle size.

The use of a cationic surfactant in the incorporation of solid inorganic particles in a matrix of metal also is disclosed in British Patent Specification No. 1,070,343. The amount of cationic surfactant employed, viz. cetyltrimethylammonium bromide, is only 10 mg per 25 grams of particles and is insufficient to cause the particles to assume a zeta-potential of at least +40 mV in an 0.005 N $KNO_3$-solution. Moreover, the disclosed surfactant is of the hydrocarbon type, which has a very unfavorable influence on the quality of the electrodeposited coating (ductility).

In the Japanese Patent Specification No. 50-45735, a surfactant of the fluorocarbon type is used in the codeposition from an electroplating bath of gold and abrasion-resistant nonmetallic particles on an article acting as cathode. In the example given in this patent, the incorporation of titanium nitride (TiN) in a coating is carried out with the use of 3 g of surfactant of the fluorocarbon type per 20 g of particles. Hence, the particles used are very small, viz. 0.05 μm, the specific surface area is very large and such a small amount of surfactant will not be sufficient to obtain a zeta-potential in an 0.005 $KNO_3$-solution of at least +40 mV. Moreover, nothing is said in this patent about the charge of the fluorocarbon surfactant used in the example.

A process is disclosed in U.S. Pat. No. 3,787,294 in which a cationic surfactant of the fluorocarbon type is used in the codeposition from an electroplating bath of a metal and graphite fluoride particles on an article acting as cathode. It is generally known, however, that graphite fluoride particles resemble polyfluorocarbon particles more than they resemble particles whose incorporation forms the subject of the present invention. This U.S. patent can therefore not be considered to contain a general teaching with regard to the incorporation of inorganic solid particles in a metal coating.

For the determination of the surface area of the particles use is preferably made of the nitrogen adsorption method of Brunauer, Emmett and Teller (BET), which is standardized in the German Industrial Standard DIN 66132.

By solid inorganic particles that can be incorporated in accordance with the process provided by the invention are to be understood here not only all particles that are of solid inorganic compounds which are inert relative to the bath conditions, such as the carbides, borides, silicides or nitrides of titanium, zirconium, wolfram, hafnium, niobium, tantalum, chromium, molybdenum, vanadium, and thorium, but also particles of simple or composite metal oxides such as $Al_2O_3$; $SiO_2$; $IrO_2$; $Cr_2O_3$; $ZrO_2$; $PbO_2$; $Pb_3O_4$; $Al_2O_3.2TiO_2$; $Beo.Sio_2$ and $ZrO_2Si$ and the like. To obtain an abrasion-resistant coating, the incorporation of SiC or $B_4C$ particles are preferred. Also, particles of metals or metal alloys can be included in composite metal coatings in accordance with the invention. Also, graphite, sulphur, silicon, diamond, sulphides (such as molybdenum disulphide) and silicates (talc, mica) can be codeposited with a metal in accordance with the invention.

The percentage of inorganic particles that may form a part of composite coatings when use is made of the process provided by the invention varies from a few percent say about 3% to the theoretically maximum volume percentage of about 70%. It has been found that the smaller the particles the more of them can be deposited from the same amount by weight per liter of bath liquid.

The process of the invention can be used for depositing the same metals as those which can be deposited from an electroplating bath by the prior art processes. As examples of these metals may be mentioned silver, iron, lead, nickel, cobalt, cadmium, copper, zinc and metallic alloys such as bronze, brass and the like.

In addition to solid inorganic particles, the electroplating baths used in the process according to the invention may contain particles of some other inorganic or organic material. As an example, a combination of SiC, $MoS_2$ and Pb-oxide+PTFE* may be codeposited. Of particular importance are resinous particles of, inter alia, polyfluorocarbon compounds, polyvinyl chloride, polyvinylidene chloride, polyolefins, polyesters, polystyrene, polyacrylates, polyamides, polyimides, aromatic polyamides and polyurethanes. If use is made of such combination of different particles it is advisable as much as possible to choose the same particle size.

*polytetrafluoroethylene

The preparation of the dispersions to be employed in the present process may be carried out in any convenient manner. It may be effected by adding the calculated amount of cationic surfactant to the electroplating bath in which the envisaged particles have been taken up or, as is preferred, first adding the wetting agent to a very strongly agitated, concentrated suspension of the particles to be occluded and subsequently adding the resulting suspension to the electroplating bath.

Particularly in the simultaneous incorporation of resinous particles, it is very much advisable that the various dispersions should be prepared separately prior to their being added to the electroplating bath.

In the process according to the invention, use should be made of cationic surface active fluorocarbon compounds such as those having one of the following structural formulae:

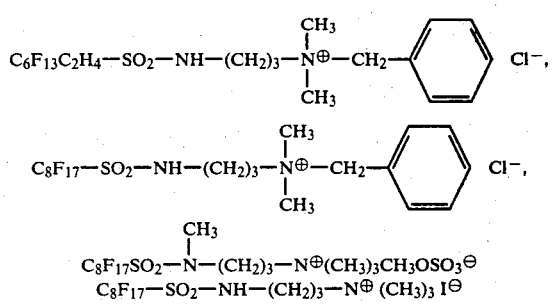

Of the above compounds, the last-mentioned one is to be preferred because it is a surfactant that gives the most favorable results. In view of the possibility of electrochemical oxidation and precipitation, it is preferred that the anion of the lastmentioned compound be replaced with a $Cl^-$ or $SO_4^{2-}$ ion.

Under some circumstances, it may be desirable for the electroplating bath also to contain a stress reducing agent, such as p-toluenesulphonamide or saccharin.

The invention will be further described in the following examples, which are all directed to the codeposition from an electroplating bath of a metal and solid inorganic particles of various chemical compositions and particle sizes. First of all, a description will be given of the general conditions used in the examples, after which the results of the experiments will be summarized in a number of tables.

The experiments, according to the process of the invention, were carried out with the use of a cationic fluorocarbon-containing surfactant. For comparison, experiments also were carried out in the presence of a cationic surfactant not containing a fluorocarbon chain, viz. a surfactant of the hydrocarbon type.

Measurement of zeta-potential

Preparatory to the experiments, first the zeta-potential of the solid inorganic particles to be incorporated by electrodeposition was measured as a function of the amount of surfactant. This was done in order to determine at what amount of surfactant the particle potential exceeded +40 mV. In the actual experiments in the electrolyte bath, a somewhat larger amount of surfactant was used than the amount thus determined. Moreover, in Example I, experiments were carried out with the same surfactant in two concentrations that were lower than the determined amount. The measurement of the zeta-potential was so carried out that as far as possible, the same concentrations of the solid inorganic particles in the aqueous dispersions were used as those that were to be employed in the electroplating bath.

In 350 ml-beakers, a series of dispersions were prepared, one of them consisting of 12½ grams of solid inorganic particles and 250 ml of demineralized water. The other dispersions of the series contained varying amounts of surfactant as well as 12½ g of solid inorganic particles and 250 ml of demineralized water. For each of the various kinds of particles, a separate series of dispersions were prepared in this way. By "various kinds of particles" are not only to be understood here particles of different chemical compositions, but also those that only differ in particle size. The contents of the beakers were homogenized for 2 minutes with an Ultra Turrax stirrer, type T 45/N of the German firm of Janke and Kunkel A. G., operating at a speed of 10,000 revolutions per minute. Subsequently, the dispersions were allowed to stand for 15 hours to permit the air to escape. Next, the dispersions were stirred with a magnetic stirrer for about 10 minutes without air occlusion and visually inspected then for stability, flocculation symptoms and sedimentation speed. Subsequently, the dispersions were stirred with the magnetic stirrer for about 5 minutes, after which from each beaker 1 ml of the dispersion was taken, which was diluted with 50 ml of an aqueous 0.05%-solution of $KNO_3$ (0.005 N $KNO_3$-solution).

Of the dispersions thus diluted, the velocity of the solid inorganic particles under the influence of an electric field was measured.

From this velocity, the electric conductivity of the dispersion and the electric field strength, the zeta-potential was calculated. For further particulars about the measurement of the zeta-potential reference is made to "Electrophoresis", Duncan J. Shaw, Academic Press, London, New York, 1969.

In the following Example I, the procedure used in the experiments will be further described. The same procedure, mutatis mutandis, is used in all the other examples. Differences, if any between the examples will appear from the respective tables. In these tables are summarized the various conditions used in the experiments and the results obtained with the experiments.

EXAMPLE I

For the electrolyte bath, use was made of a Watt's nickel plating bath, the solid inorganic particles of silicon carbide having being supplied by Kempten GmbH, Munich, under the name SiC 1200. They are particles having a mesh value of 1200 and an average size of about 5 μm.

A 1½ liter nickel plating bath was prepared employing the following ingredients:

| | grams/liter |
|---|---|
| $NiSo_4 \cdot 6H_2O$ | 240 |
| $NiCl_2 \cdot 6H_2O$ | 40 |
| $H_3BO_3$ | 40 |

The pH was 4.2 and the temperature was 52° C.

To this bath there were added 75 grams of $SiC_{1200}$ and 375 mg of a cationic fluorocarbon surfactant, i.e., 5 mg of surfactant per 1 gram of SiC. The surfactant had the following structural formula:

$$2\left[C_8F_{17}SO_2\overset{H}{\overset{|}{N}}(CH_2)_3-N^{\oplus}(CH_3)_3\right]SO_4^{2-}$$

In a 200 ml-beaker, this mixture was homogenized with an Ultra Turrax stirrer of the type mentioned before at a speed of 10,000 revolutions per minute. Subsequently, the resulting dispersion was gently stirred for one-half hour at a temperature of 52° C. with an IKA Combimag magnetic stirrer to allow the escape of air occluded in the preceding stirring operation.

As could afterwards be established, the dispersion obtained looked moderately stable.

As cathode now a round bar of stainless steel 60 mm long and 4 mm in diameter was hung in the bath contained in the beaker. The bar had been pretreated successively by blasting with granular corundum having a mesh value of 220, rinsing, degreasing with an alkaline detergent, rinsing, activating in a boiling solution of $FeCl_3$ and again rinsing with water.

The anode hanging in the beaker consisted of a nickel plate 1 mm thick, 8 cm high, and 15 cm long and was so bent that it was just touching the inside wall of the beaker. The anode and the cathode were then connected to a current source supplying a direct current of 0.75 A.

So, considering the cylindrical outer surface area of the cathode, the current density was 10 A/dm². The electrodepositing lasted 15 minutes, the bath being moderately stirred to prevent sedimentation of SiC particles. Next, the cathode and the anode were removed from the beaker, rinsed with water and transferred to a beaker of the same dimensions containing a normal Watt's nickel plating bath (without SiC or surfactant). In this bath, the cathode bar was subjected to a continued electroplating treatment lasting 30 minutes at a current density of 5 A/dm². As a result, a second coating consisting of nickel was deposited on the composite coating of nickel and silicon carbide formed in the first electroplating step.

Of the bar thus treated, a 15 mm long piece was sawed off and entirely embedded in a solidifying mass. Then the integrated whole of embedding mass and bar was ground off until a semi-cylindrical part of the bar was left, the outer nickel coating serving as a supporting layer. On the fine-ground face, the incorporated darker SiC particles could be very well distinguished from the lighter nickel.

The uniformity of distribution of the SiC particles in the nickel could, therefore, be very well determined visually. The volume percentage of incorporated SiC particles was determined with a Zeiss microvideomat. The experiment was carried out at three different concentrations of surfactant, based on the amount by weight of SiC particles:

a. 5 mg of surfactant per gram of SiC
b. 10 mg of surfactant per gram of SiC
c. 20 mg of surfactant per gram of SiC The results of the experiment are summarized in Table 1, which also gives the above-mentioned experimental conditions.

By the term "zeta-potential without surfactant" used in this table and also in other tables is meant the zeta-potential which was measured with the dispersion which exclusively contained the respective inorganic particles and demineralized water.

As is shown by Table 1, the use of 5 and 10 mg of surfactant per gram of particles resulted in incorporating only a small amount of SiC, which moreover was not homogeneously distributed in the nickel. The zeta-potentials in the corresponding 0.005 N $KNO_3$-solutions were below +40 mV and were −25 and +12 mV, respectively. It was also found that during the dispersing of the electrolyte, the particles and the surfactant, using 5 and 10 mg of surfactant per gram of SiC, respectively, a flocculent mixture was formed.

Both quantitatively and qualitatively the incorporation was considerably better when use was made of 20 mg of surfactant per gram of particles having a zero-potential of +76 mV. The volume percentage of the incorporated SiC particles was 57, and the particles were homogeneously distributed in the nickel.

EXAMPLE II

The procedure used in Example I was repeated with SiC particles having a size of about 15 μm and supplied by the Dutch firm of Norton at Rotterdam under the name SiC 500. The conditions and the results are given in Table 2.

EXAMPLE III

In the experiment on which this example is based, the solid inorganic particles were of $B_4C$. Particles of this boron carbide having a particle size of about 2 μm, known under the name $B_4C_{1500}$, had been obtained from the German firm of Kempten GmbH, Munich.

Use was made of a nickel sulfamate bath and a different cationic fluorocarbon surfactant from the one used in Examples I and II. The surfactant of this Example II had as the structural formula

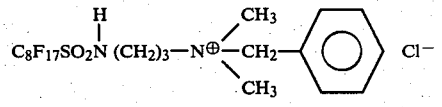

Further conditions and the results of this experiment are included in Table 3. The table shows that under the given conditions the particles were quite satisfactorily incorporated, both quantitatively and qualitatively, also when use was made of boron carbide.

EXAMPLE IV

In this example, use was made of solid inorganic $MoSi_2$ particles supplied by the firm of Starck at West-Berlin. The bath was again a Watt's nickel plating bath and the surfactant again of the type used in the Examples I and II. Additional data are mentioned in Table 4. Also in this experiment, both a qualitatively and quantitatively satisfactory incorporation of particles was obtained.

EXAMPLE V

The material of the solid inorganic particles in this experiment was a diamond powder supplied by the Swiss firm of Rudolf Spring A. G. under the name Diamond grade 3. Use was made of a nickel sulfamate bath and the same type of surfactant as employed in Example III. Table 5 gives further particulars about the conditions used in and the results obtained by the experiment. Considering the relatively small concentration of diamond powder (as little as 20 g/liter bath liquid) a remarkably high percentage of incorporated diamond powder was reached (28%) compared with the percentage obtained with the known electroplating process for deposition of metals and diamond powder.

EXAMPLE VI

In the experiment relating to this example, the solid inorganic substance consisted of chromium powder having a particle size of about 2 μm. The powder had been supplied by the American firm of Alfa Products at Danvers. The experiment was again carried out in a Watt's nickel plating bath, use being made of the same surfactant as in Example I. The conditions and the results of the experiment are given in Table 6. The composite layer contained 47 percent by volume of chromium powder which was homogeneously distributed in it. When this experiment was carried out in accordance with the procedure described in British Patent Specification No. 1,070,343, using as surfactant n-hexadecyltrimethyl ammonium bromide (CTAB) (a nonfluorocarbon-containing surfactant) the zeta potential was found to have a value not exceeding +20 mV. The particles were not homogeneously distributed over the surface.

The resulting coating was black and had a poor appearance.

In the following three comparative examples use was made, as in Example I, of a Watt's nickel plating bath containing dispersed silicon carbide particles referred to as $SiC_{1200}$. However, instead of with a cationic fluorocarbon surfactant, the treatment was carried out in the presence of cationic hydrocarbon surfactants.

EXAMPLE VII

The cationic hydrocarbon surfactant had the following structural formula:

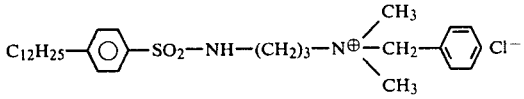

The conditions and results of the experiments are shown in Table 7.

EXAMPLE VIII

The cationic surfactant used here had the following structural formula:

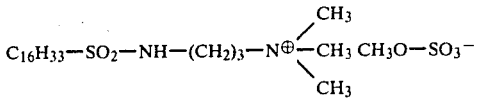

Additional data are mentioned in Table 8.

EXAMPLE IX

In the experiment carried out according to this example use was made of a cationic surfactant having the structural formula:

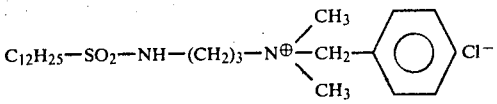

Table 9 gives additional data on experimental conditions and results.

Although in all the comparative Examples VII–IX, the zeta potential can be seen to lie above the set lower limit of +40 mV, the use of a cationic surfactant which is not of the fluorocarbon type results in the incorporation of a considerably smaller amount of SiC than is the case in Example I for a zero-potential of +76 mV (0, 12 and 10 percent by volume in the Examples VII, VIII and IX, respectively, against 57 percent by volume in Example I).

EXAMPLE X

In the experiment according to this example, use was made of a mixture of two inorganic substances. One substance was $SiC_{1200}$, as employed in Example VIII. The other substance was molybdenum disulphide having a particle size of about 25 μm. It had been obtained from the Swiss firm of Fluka A. G.

The experiment was again carried out in a Watt's nickel plating bath, use being made of the same surfactant as in Example I. In table 10, the conditions used and the results obtained are summarized. The composite layer contained 27 percent by volume of silicon carbide and 18 percent by volume of molybdenum disulphide. Both substances were homogeneously distributed in the metal coating.

Although the invention has been described in detail for the purposes of illustration, it is to be understood that such detail is solely for the purpose of illustration and that variations can be made therein without departing from the spirit and scope of the invention except as it may be limited by the claims.

TABLE 1

| | | |
|---|---|---|
| Inorganic particles | supplier | Kempten GmbH |
| | particle size | about 5 μm |
| | density | 3.25 g/cm |
| | specific surface area | about 2 $m^2/g$ |

TABLE 1-continued

| | | |
|---|---|---|
| silicium-carbide ("Sic 1200") | zeta potential without surfactant | −57 mV |
| | zeta potential with surfactant in a concentration of | |
| | a. 5 mg per g of particles | −25 mV |
| | b. 10 mg per g of particles | +12 mV |
| | c. 20 mg per g of particles | +76 mV |
| | content in the bath | 50 g/liter |
| Surfactant | type | cationic, FC-type |
| | structure | $2\left[C_8F_{17}SO_2\overset{H}{\overset{\vert}{N}}(CH_2)_3\overset{\oplus}{N}(CH_3)_3\right]SO_4^{2-}$ |
| | content relative to the inorganic particles | a. 5 mg surf./gram of particles<br>b. 10 mg surf./gram of particles<br>c. 20 mg surf./gram of particles |
| electrolyte bath | $NiSO_4 . 6 H_2O$ | 240 g/l |
| | $NiCl_2 . 6 H_2O$ | 40 g/l |
| | $H_3BO_3$ | 40 g/l |
| Watt's nickel plating bath | pH | 4.2 |
| | temperature | 52° C. |
| | bath vessel | 2000 ml-beaker |
| | anode | bent nickel plate |
| | cathode | stainless steel bar, 4mm diam., 60 mm long |
| | current density | 10 A/dm$^2$ |
| | bath agitation | moderate (with magnetic stirrer) |
| | electroplating time | 15 minutes |
| dispersing of mixture, electrolyte, particles and surfactant | stirrer | Ultra Turrax |
| | stirrer speed | 10 0000 r.p.m. |
| | stirring time | 1 minute |
| | rating of mixture with: | |
| | a. 5 mg surf. per g of part | flocculent |
| | b. 10 mg surf. per g of part | very flocculent |
| | c. 20 mg surf. per g of part | homogeneous and stable |
| composite coating of nickel and SiC particles | volume percentage/distribution of incorporated particles with: | |
| | a. 5 mg surf. per g of part | 9%/inhomogeneous |
| | b. 10 mg surf. per g of part | 4%/inhomogeneous |
| | c. 20 mg surf. per g of part | 57%/homogeneous |
| | coating thickness | 30 μm |

TABLE 2

| | | |
|---|---|---|
| Inorganic particles | supplier | Norton, Rotterdam |
| | particle size | about 15 μm |
| | density | 3.25 g/cm$^3$ |
| | specific surface area | about 0.7 m$^2$/g |
| Silicium carbide ("SiC 500") | zeta potential without surfactant | −38 mV |
| | zeta potential with surfactant in a concentration of 25 mg per g of particles | +65 MV |
| | content in the bath | 35 g/ liter |
| surfactant | type | Same as in Table 1 |
| | structure | |
| | content relative to the inorganic particles | 25 mg of surfactant/gram of particles |
| electrolyte bath | $NiSO_4 . 6 H_2O$ | 240 g/l |
| | $NiCl_2 . 6 H_2O$ | 40 g/l |
| | $H_3BO_3$ | 40 g/l |
| Watt's nickel plating bath | pH | 4,1 |
| | temperature | 50° C. |

TABLE 2-continued

| | | |
|---|---|---|
| | bath vessel | 1500 ml-beaaker |
| | anode | nickel grains in bag |
| | cathode | stainless steel bar 4 mm diam, 60 mm long |
| | current density | 5 A/dm$_2$ |
| | bath agitation | moderate |
| | electroplating time | 150 minutes |
| dispersing of mixture, electrolyte, particles and surfactant | stirrer | ultra Turrax |
| | stirrer speed | 10 000 r.p.m. |
| | stirrer time 4 minutes | |
| composite coating of nickel and SiC particles | volume percentage / distribution of incorporated particles with 25 mg of surfactant per g of particles | 40%/homogeneous |
| | coating thickness | about 180 μm. |

TABLE 3

| | | |
|---|---|---|
| Inorganic particles | supplier | Kempten GmbH |
| | particle size | about 2 μm |
| | density | 2.52 g/cm$^3$ |
| | specific surface area | about 6 m$^2$/g |
| boron carbide ("$B_4C_{1500}$") | zeta-potential without surfactant | −50 mV |

TABLE 3-continued

| | | |
|---|---|---|
| | zeta potential with surfactant in a concentration of 50 mg per gramme of particles | +72 mV |
| | content in the bath | 30 g/l |
| surfactant | type | cationic FC-type |
| | structure | 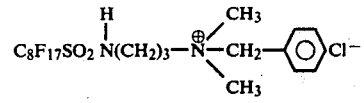 |
| | content relative to the inorganic particles | 50 mg surf./gram of particles |
| electrolyte bath | $Ni(NH_2SO_3)_2$ | 460 g/l |
| | $NiCl_2$ | 5 g/l |
| | $H_3BO_3$ | 40 g/l |
| nickel sulfamate bath | pH | 4.1 |
| | temperature | 55° C. |
| | bath vessel | 2000 ml-beaker |
| | anode | bent nickel plate |
| | cathode | stainless steel bar 4 mm in diam., 60 mm long |
| | current density | 15 A/dm$^2$ |
| | bath agitation | moderate (with magn. stirrer) |
| | electroplating time | 15 minutes |
| dispersing of mixture, electrolyte, particles and surfactant | stirrer | Ultra Turrax |
| | speed of stirrer | 10 000 r.p.m. |
| | stirring time | 2 minutes |
| composite coating of nickel and $B_4C$ particles | volume percentage/distribution of incorporated particles with 50 mg of surf. per g of particles | 45%/homogeneous |
| | coating thickness | 50 μm |

TABLE 4

| | | |
|---|---|---|
| Inorganic particles | supplier | Starck, Berlin |
| | particle size | 5 to 6 μm |
| | density | abt 6.2 g/cm$^3$ |
| | specific surface area | abt 1.5 m$^2$/g |
| $MoSi_2$ | zeta-potential with surfactant in a concentration of 30 mg per gramme of particles content in the bath | abt +60 mV |
| surfactant | type | Same as in Table 1 |
| | structure | |
| | content relative to the inorganic particles | 30 mg of surf./gram of particles |
| electrolyte bath | $NiSO_4 . 6H_2O$ | 240 g/l |
| | $NiCl_2 . 6 H_2O$ | 40 g/l |
| | $H_3BO_3$ | 40 g/l |
| | pH | 4.1 |
| | temperature | 55° C. |
| Watt's nickel plating bath | bath vessel | 2000 ml-beaker |
| | anode | bent nickel plate |
| | cathode | stainless steel bar, 4 mm diam., 60 mm long |
| | current density | 5 A/dm$^2$ |
| | bath agitation | moderate (with magnetic stirrer) |
| | electroplating time | 60 minutes |
| dispersing of mixture, electrolyte particles and surfactant | stirrer | Ultra Turrax |
| | stirrer speed | 10 000 r.p.m. |
| | stirring time | 2 minutes |
| composite coating of nickel and molybdenum silicide | volume percentage/distribution of incorporated particles with 30 mg of surfactant per g of particles | 32%/homogeneous |
| | coating thickness | about 60 μm |

TABLE 5

| | | |
|---|---|---|
| Inorganic particles | supplier | Rudolf Spring A.G. |
| | particle size | 2 to 4 μm |
| | density | 3.25 g/cm$^3$ |
| | specific surface area | 3.9 m$^2$/g |
| Diamond grade 3 | zeta-potential without surfactant | −38 mV |
| | zeta-potential with surfactant in a concentration of 20 mg per gramme of particles | +65 mV |
| | content in the bath | 20 g/l |
| surfactant | type | as in Table 3 |
| | structure | |
| | content relative to the inorganic particles | 20 mg of surfactant per g of particles |
| electrolyte bath | $Ni(NH_2SO_3)_2$ | 460 g/l |
| | $NiCl_2$ | 5 g/l |
| | $H_3BO_3$ | 40 g/l |
| | pH | 4.1 |
| nickel sulfamate bath | temperature | 55° C. |
| | bath vessel | 2000 ml-beaker |
| | anode | bent nickel plate |
| | cathode | stainless steel bar, 4 mm in diam., 60 mm long |
| | current density | 10 A/dm$^2$ |
| | bath agitation | moderate (with magnetic stirrer) |
| | electroplating time | 15 minutes |
| dispersing of mixture, electrolyte, particles and surfactant | stirrer | Ultra Turrax |
| | stirrer speed | 10 000 r.p.m. |
| | stirring time | 2 minutes |
| composite coating of nickel and diamond powder | volume percentage/distribution of the incorporated particles with 20 mg of surfactant per g of particles | 28%/homogeneous |
| | coating thickness | |

TABLE 5-continued

| | | |
|---|---|---|
| | | about 30 μm |

TABLE 6

| | | |
|---|---|---|
| Inorganic particles | supplier | Alfa Products |
| | particle size | about 2 μm |
| | density | 7.1 g/cm$^3$ |
| | specific surface area | 0.85 m$^2$/g |
| chromium powder | zeta-potential without surfactant | −35 mV |
| | zeta-potential with surfactant in a concentration of 25 mg per gramme of particles | +55 mV |
| | content in the bath | 50 g/l |
| Surfactant | type | as in Table 1 |
| | structure | |
| | content relative to the inorganic particles | 25 mg of surfactant per 1 g of particles |
| electrolyte bath | $NiSO_4 . 6 H_2O$ | 240 g/l |
| | $NiCl_2 . 6 H_2O$ | 40 g/l |
| | $H_3BO_3$ | 40 g/l |
| | pH | 4.1 |
| Watt's nickel plating bath | temperature | 50° C. |
| | bath vessel | 2000 ml-beaker |
| | anode | bent nickel plate |
| | cathode | stainless steel bar, 4 mm in diam, 60 mm long |
| | current density | 5 A/dm$^2$ |
| | bath agitation | moderate (with magnetic stirrer) |
| | electroplating time | 50 minutes |
| dispersing of mixture, electrolyte, particles and surfactant | stirrer | Ultra Turrax |
| | stirrer speed | 10 000 r.p.m. |
| | stirring time | 1½ minutes |
| composite coating of nickel and chromium powder | volume percentage/distribution of incorporated particles with 25 mg of surfactant per 1 g of particles | 47%/homogeneous |
| | coating thickness | about 52 μ |

TABLE 7

| | | |
|---|---|---|
| Inorganic particles | supplier | Kempten G.m.b.H. |
| | particle size | about 5 μm |
| | density | 3.25 g/cm$^3$ |
| | specific surface area | about 2 m$^2$/g |
| silicium carbide ("SiC 1200") | zeta-potential without surfactant | −57 mV |
| | zeta-potential with surfactant in a concentration of 30 mg per 1 gramme of particles | +65 mV |
| | content in the bath | 50 g/l |
| Surfactant | type | cationic CH-type |
| | structure | 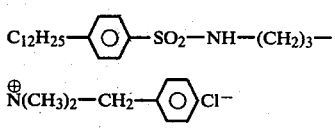 |
| | content relative to the inorganic particles | 30 mg of surfactant per 1 g of particles |
| electrolyte bath | $Ni(NH_2SO_3)_2$ | 460 g/l |
| | $NiCl_2$ | 5 g/l |
| | $H_3BO_3$ | 40 g/l |
| | pH | 4.2 |
| Nickel sulfamate bath | temperature | 55° C. |
| | bath vessel | 2000 ml-beaker |
| | anode | nickel plate |
| | cathode | stainless steel bar, 4 mm in diam., 60 mm long |
| | current density | 15 A/dm$^2$ |
| | bath agitation | moderate (with magnetic stirrer) |
| | electroplating time | 15 minutes |
| dispersing of mixture, electrolyte, particles and surfactant | stirrer | Ultra Turrax |
| | stirrer speed | 10 000 r.p.m. |
| | stirring time | 2 minutes |
| | rating of mixture with 30 mg of surfactant per 1 g of particles | very flocculent |
| composite coating of nickel and silicium carbide | volume percentage/distribution of the incorporated particles with 30 mg of surfactant per 1 g of particles | 0% |
| | coating thickness | about 50 μm |

TABLE 8

| | | |
|---|---|---|
| Inorganic particles | supplier | Kempten GmbH |
| | particle size | about 5 μm |
| | density | 3.25 g/cm$^3$ |
| | specific surface area | about 2 m$^2$/g |

TABLE 8-continued

| | | |
|---|---|---|
| | zeta-potential without surfactant | −57 mV |
| silicium carbide ("$SiC_{1200}$") | zeta-potential with surfactant in a concentration of 30 mg per 1 gramme of particles | +90 mV |
| | content in the bath | 50 g/l |
| Surfactant | type | cationic, CH-type |
| | structure | $C_{16}H_{33}—SO_2—NH—(CH_2)_3—\overset{\oplus}{N}—(CH_3)_3$ $CH_3O—SO_3$ |
| | content relative to the inorganic particles | 30 mg of surfactant per 1 g of particles |
| electrolyte bath | $Ni(NH_2SO_3)_2$ | 460 g/l |
| | $NiCl_2$ | 5 g/l |
| | $H_3BO_3$ | 40 g/l |
| | pH | 4.2 |
| nickel sulfamate bath | temperature | 55° C. |
| | bath vessel | 2000 ml-beaker |
| | anode | nickel plate |
| | cathode | stainless steel bar, 4 mm in diam., 60 mm long |
| | current density | 15 A/dm$^2$ |
| | bath agitation | moderate (magnetic stirrer) |
| | electroplating time | 2 minutes |
| dispersing of mixture, electrolyte, particles and surfactant | stirrer | Ultra Turrax |
| | stirrer speed | 10,000 r.p.m. |
| | stirring time | 2 minutes |
| | rating of mixture with 30 mg of surfactant per 1 gramme of particles | slightly flocculent |
| composite coating of nickel and silicium carbide | volume percentage/distribution of incorporated particles with 30 mg of surfactant per 1 gramme of particles | 12%/inhomogeneous |
| | coating thickness | 50 μm |

TABLE 9

| | | |
|---|---|---|
| Inorganic particles | supplier | Kempten GmbH |
| | particle size | about 5 μm |
| | density | 3.25 g/cm$^3$ |
| | specific surface area | about 2 m$^2$/g |
| silicium carbide ("$SiC_{1200}$") | zeta-potential without surfactant | −57 mV |
| | zeta-potential with surfactant in a concentration of 30 mg per 1 gramme of particles | +50 mV |
| | content in the bath | 50 g/l |
| Surfactant | type | cationic, CH—type |
| | structure | $C_{12}H_{25}—SO_2—NH—(CH_2)_3—\overset{\oplus}{N}(CH_3)_2—CH_2—C_6H_5\ Cl^-$ |
| | content relative to the inorganic particles | 30 mg of surfactant per 1 g of particles |
| electrolyte bath | $Ni(NH_2SO_3)_2$ | 460 g/l |
| | $NiCl_2$ | 5 g/l |
| | $H_3BO_3$ | 40 g/l |
| | pH | 4.2 |
| nickel sulfamate bath | temperature | 55° C. |
| | bath vessel | 2000 ml-beaker |
| | anode | nickel plate |
| | cathode | stainless steel bar 4 mm in diam. 60 mm long |
| | current density | 15 A/dm$^2$ |
| | bath agitation | moderate (magn. stirrer) |
| | electroplating time | 15 minutes |
| dispersing of mixture, | stirrer | Ultra Turrax |
| | stirrer speed | 10 000 r.p.m. |

TABLE 9-continued

| | | |
|---|---|---|
| electrolyte, particles and surfactant | stirring speed | 2 minutes |
| | rating of mixture with 30 mg of surfactant per 1 gramme of particles | slightly flocculent |
| composite coating of nickel and silicium carbide | volume percentage/distribution of the incorporated particles with 30 mg of surfactant per 1 g of particles | 10%/inhomogeneous |
| | coating thickness | 50 μm |

TABLE 10

| | | |
|---|---|---|
| Inorganic particles | supplier of $MoS_2$ | Fluka A.G. |
| | particle size | abt 25 μm |
| | density | 4.8 g/cm$^3$ |
| | specific surface area | 0.5 m$^2$/g |
| silicium carbide | zeta-potential without surfactant | |
| | of SiC | −55 mV |
| | of $MoS_2$ | not measurable (strongly hydrophobic) |
| as in example VIII and $MoS_2$ | with surfactant in a concentration of | |
| | 25 mg per g SiC | +65 mV |
| | 25 mg per g $MoS_2$ | +55 mV |
| | content in the bath | 25 g/l SiC and 25 g/l $MoS_2$ |
| Surfactant | type | cationic, FC-type |
| | structure | $2\left[C_8F_{17}SO_2\overset{H}{\overset{\vert}{N}}(CH_2)_3-\overset{\oplus}{N}(CH_3)_3\right]SO_4^{2-}$ |
| | content relative to the inorganic particles | both for SiC and $MoS_2$ 25 mg/l |
| electrolyte | $NiSO_4 . 6 H_2O$ | 240 g/l |
| | $NiCl_2 . 6 H_2O$ | 40 g/l |
| | $H_3BO_3$ | 40 g/l |
| | pH | 4.2 |
| Watt's nickel plating bath | temperature | 52° C. |
| | bath vessel | 2000 ml-beaker |
| | anode | bent nickel plate |
| | cathode | stainless steel bar, 4 mm in diam. 60 mm long |
| | current density | 7.5 A/dm$^2$ |
| | bath agitation | moderate (with magnetic stirrer) |
| | electroplating time | 30 minutes |
| dispersing of mixture, electrolyte particles and surfactant | stirrer | Ultra Turrax (the two substances at once) |
| | stirrer speed | 10 000 r.p.m. |
| | stirring time | 2 minutes |
| composite coating of nickel and chromium powder | volume percentage/distribution of incorporated particles with 25 mg/g for the two types of particles | SiC : 27 volume %<br>$MoS_2$ : 13 volume %<br>both substances were homogeneously distributed within each other |
| | coating thickness | about 45 μm |

What is claimed is:

1. In a process for the codeposition from an electroplating bath of a metal and solid inorganic particles on an article acting as a cathode, which particles are kept suspended in the bath liquid in the presence of a surfactant and have an average size of less than 300 μm and are used in a concentration of 10 to 150 grams per liter of bath liquid, characterized in that the surfactant is a cationic fluorocarbon compound in at least the same weight ratio to the particles in the bath liquid as in an 0.005 N $KNO_3$-solution in which the particles assume a zeta-potential of at least +40 mV with the exclusive use of said cationic fluorocarbon compound.

2. The process of claim 1, characterized in that the amount of cationic fluorocarbon compound is equal to that required in a 0.005 N $KNO_3$ solution for the particles to assume a zeta-potential of at least +60 mV with the exclusive use of said cationic fluorocarbon compound.

3. The process of claim 1 or 2, characterized in that the cationic fluorocarbon compound is a compound having one of the following structural formulae:

$$2\left[C_8F_{17}SO_2-\overset{H}{\overset{\vert}{N}}-(CH_2)_3-N^{\oplus}(CH_3)_3\right]SO_4^{2-} \text{ or}$$

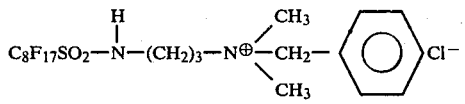

4. The process according to claim 1 or 2 characterized in that besides solid inorganic particles, solid particles of a different kind are simultaneously deposited.

5. The process according to claim 4, characterized in that the said different kind of solid particles are inorganic particles, too.

6. The process according to claim 4, characterized in that the said different kind of solid particles are organic particles.

7. In a process for electrolytically codepositing a metal and particles of an inorganic compound simultaneously on a cathode which comprises depositing said metal and particles from a bath containing as the only surfactant a cationic fluorocarbon surfactant and the said particles have a zeta-potential of at least +40 mV.

8. The product of the process of claim 7.

9. The process of claim 4 wherein said different kind of particles are organic fluorocarbon particles.

* * * * *